United States Patent [19]

Komatsu et al.

[11] 4,347,889

[45] Sep. 7, 1982

[54] DIECASTING APPARATUS

[75] Inventors: Mikiya Komatsu; Shunsuke Suzuki, both of Yokohama; Takasumi Maruyama, Yokosuka, all of Japan

[73] Assignee: Nissan Motor Co., Ltd., Yokohama, Japan

[21] Appl. No.: 109,394

[22] Filed: Jan. 3, 1980

[30] Foreign Application Priority Data

Jan. 9, 1979 [JP] Japan ..... 54/366

[51] Int. Cl.[3] ..... B22D 17/00

[52] U.S. Cl. ..... 164/250.1; 164/312; 164/80; 164/113; 164/338.1; 164/513

[58] Field of Search ..... 164/80, 338 R, 338 M, 164/338 H, 113, 119, 120, 284, 303–308, 312–315, 50, 51, 250, 251, 62–66

[56] References Cited

U.S. PATENT DOCUMENTS

| | | | |
|---|---|---|---|
| 2,398,318 | 4/1946 | MacMillin et al. | 164/113 |
| 2,867,867 | 1/1959 | Hodler | 164/305 |
| 3,006,043 | 10/1961 | Goldhamer | 164/62 X |
| 3,072,982 | 1/1963 | Gordon et al. | 164/65 X |
| 3,443,628 | 5/1969 | Carr | 164/313 |
| 3,528,478 | 9/1970 | Koch et al. | 164/113 |
| 4,050,503 | 9/1977 | Balevski et al. | 164/119 |
| 4,088,178 | 5/1978 | Ueno et al. | 164/312 |

FOREIGN PATENT DOCUMENTS

| | | | |
|---|---|---|---|
| 1055187 | 4/1959 | Fed. Rep. of Germany | 164/315 |
| 2720352 | 11/1977 | Fed. Rep. of Germany | 164/66 |
| 50-124831 | 10/1975 | Japan . | |
| 52-133824 | 11/1977 | Japan . | |
| 51-51664 | 12/1977 | Japan . | |
| 54-17324 | 2/1979 | Japan | 164/284 |
| 203488 | 6/1939 | Switzerland | 164/312 |
| 1413821 | 11/1975 | United Kingdom . | |

*Primary Examiner*—Gus T. Hampilos
*Assistant Examiner*—K. Y. Lin
*Attorney, Agent, or Firm*—Silverman, Cass & Singer, Ltd.

[57] ABSTRACT

A diecasting apparatus according to the invention comprises an injection cylinder vertically arranged having its upper end communicating with a cavity of dies for diecasting, a melt chamber cylinder coaxially located below the injection cylinder and having an inner diameter substantially the same as that of the injection cylinder, a plunger movable through the melt chamber and injection cylinders to form a melt chamber defined by an upper surface of the plunger and an inner surface of the melt chamber cylinder, thereby to form a hermetically closed space by the melt chamber and cavity, and heating and melting means arranged about the melt chamber cylinder, thereby enabling the molten material to be injected into the cavity through the shortest distance for the shortest period of time, whereby high quality diecast products of high melting point metals are obtained.

6 Claims, 8 Drawing Figures

DIECASTING APPARATUS

BACKGROUND OF THE INVENTION

1. Field of the Invention

The present invention relates to a diecasting apparatus.

2. Description of the Prior Art

Usual diecasting apparatuses are generally classified into two kinds; a horizontal diecasting apparatus whose molten metal injecting system is substantially horizontally arranged for horizontally injecting molten metal into dies and a vertical diecasting apparatus whose injecting system is substantially vertically arranged for vertically injecting molten metal into dies. The former has disadvantages in that in a pouring step a molten metal at a high temperature spreads at the bottom of an injection cylinder and remains thereat for a relatively long period of time, so that the molten metal tends to cool rapidly during the time from pouring to injecting and also tends to entrain air into a cavity when being injected. It is therefore difficult for the horizontal diecasting apparatus to obtain high quality diecast products. On the other hand, with the vertical diecasting apparatus, although it is improved by having less areas in contact with the air, it has also disadvantages in that the pouring operation of molten metal into an injection cylinder is troublesome and the molten metal still tends to cool due to its staying in an injection cylinder for a long period of time.

As can be seen from the above description, the hitherto used diecasting methods have an important disadvantage of imposing on operators a process of pouring a molten metal into an injection cylinder from a melting shop, a maintaining furnace, a temperature keeping furnace or the like arranged near the diecasting apparatus by means of a ladle or other means. In this case, it is clear that prevention of the molten metal from cooling is impossible and a continuous handling of the molten metal with safety and security is difficult. Particularly, as the molten metal at a high temperature is poured with the aid of its head, problems of thermal cracks, welding of the molten metal or the like arise on the injection cylinder where the molten metal falls. This phenomenon is particularly acute in high melting point metals, which considerably shortens the life of the part against which the molten metal is poured. Moreover, with the high melting point metals including titanium, aluminum or the like the transferring and pouring of the molten metals in the air greatly affects the quality of diecast products, so that high quality diecast products could not be obtained in the prior art.

In order to solve the above problems, it has been suggested to melt a high melting point metal immediately above a pouring gate of an injection cylinder and then pour it by falling. This method achieves a shortening of the time and distance for transferring the molten metal, but still gives rise to a thermal shock at the place where the molten metal falls, and the molten metal cools during the time from pouring to injection in the same manner as above described. On the other hand, it has been proposed to pour a molten metal from a warm keeping furnace into an injection cylinder by means of electromagnetic force or pneumatic pressure. This method requires to keep the passage of the molten metal warm sufficiently, and is difficult to obtain a fixed quantity of diecast products and an apparatus for this method is highly expensive and complicated and bulky in construction requiring a wide space for an installation.

SUMMARY OF THE INVENTION

It is an object of the invention to provide an improved diecasting apparatus which eliminates the disadvantages in the prior art.

It is another object of the invention to provide a diecasting apparatus which shorten the cycle time of diecasting operation by simplifying a series of molten metal handling operations such as melting shop, transferring of the molten metal or the like which would otherwise be used in the prior art, and which enables the molten metal melted in a melt chamber to be injected and filled in a cavity of dies through the shortest distance for the shortest period of time thereby stably obtaining high quality diecast products of high melting point metals.

A diecasting apparatus according to the invention comprises an injection cylinder vertically arranged having its upper end communicating with a cavity for diecasting, a melt chamber cylinder coaxially located below said injection cylinder and having an inner diameter substantially the same as that of said injection cylinder, a movable plunger passing through said melt chamber cylinder and said injection cylinder to form a melt chamber defined by an upper surface of said plunger and an inner surface of said melt chamber cylinder, said plunger, said melt chamber cylinder, said injection cylinder and said cavity forming a hermetically closed space, and heating and melting means arranged about said melt chamber cylinder for melting material to be accommodated in said melt chamber.

A diecasting method according to the invention comprises the steps of supplying material to be melted into a melt chamber defined by a melt chamber cylinder arranged coaxially under a vertically arranged injection cylinder and an upper surface of a movable plunger extending through said injection and melt chamber cylinders, melting said material in said melt chamber by means of heating and melting means arranged around said melt chamber, and injecting and filling said molten material in a cavity of dies communicated with said injection cylinder by a raising movement of said plunger.

In order that the invention may be more clearly understood, preferred embodiments will be described, by way of example, with reference to the accompanying drawings.

DETAILED DESCRIPTION OF THE PREFERRED EMBODIMENT

Figure 1:
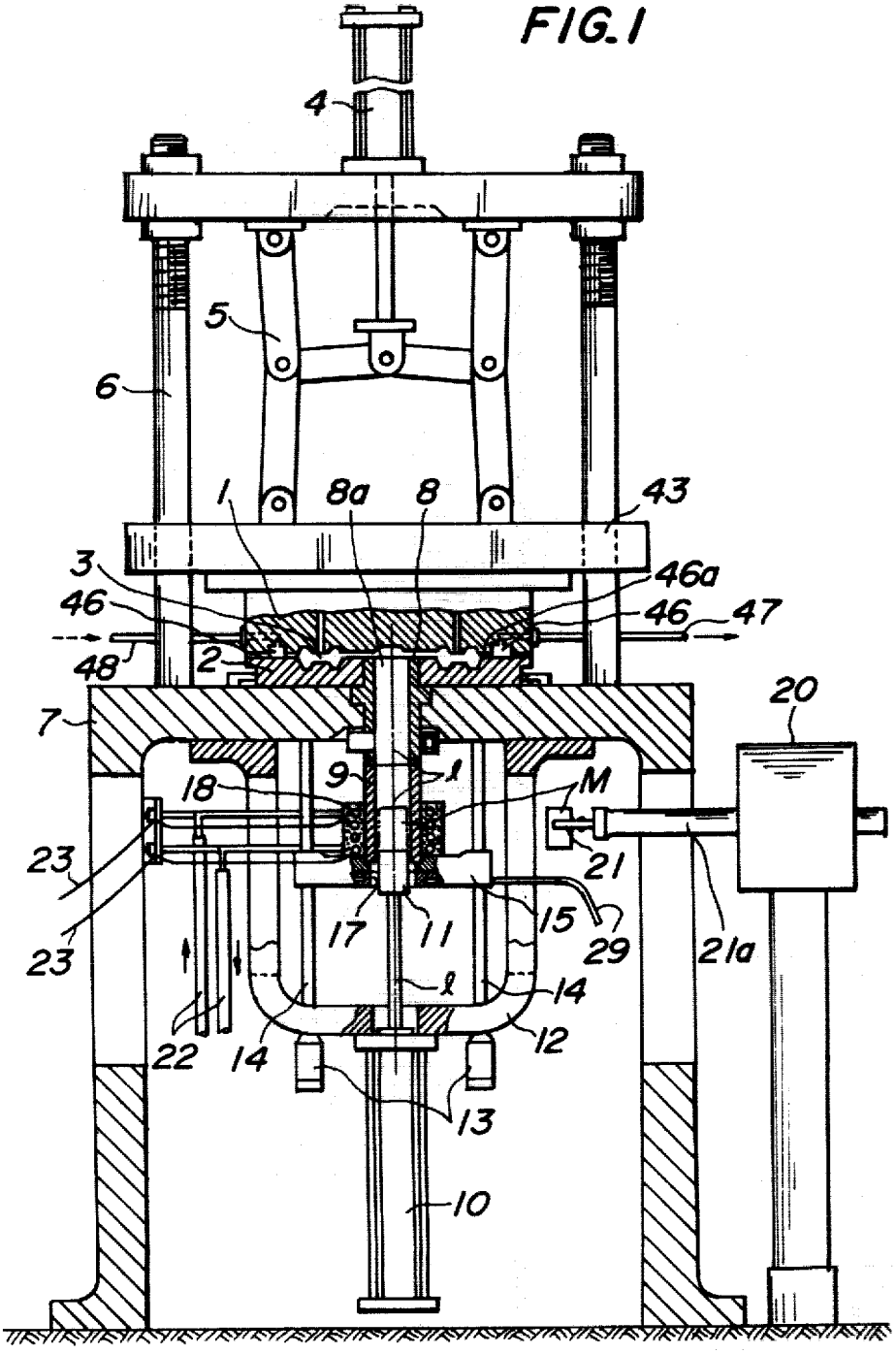
FIG. 1 is a front elevation of one embodiment of the diecasting apparatus according to the invention.

Referring to FIG. 1 there is illustrated one embodiment of a diecasting apparatus which indicates the essential feature of the invention. Upper and lower dies 1 and 2 form a cavity 3 corresponding in shape to diecast products. The upper die or movable die 1 is vertically movable guided by guide bars 6 through a toggle mechanism 5 by means of a die clamping cylinder 4. The lower die or stationary die 2 is fixed to an upper surface of a substantially inverted U-shaped base 7 forming a lower structure of the apparatus to form the cavity 3 with the movable die 1.

Figure 2:
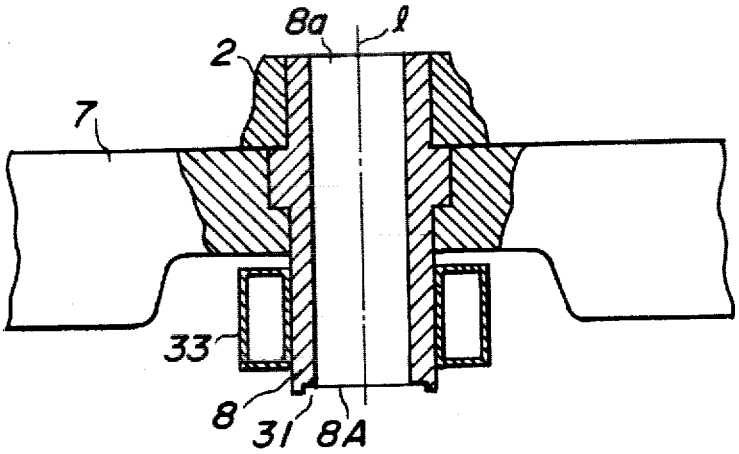
FIG. 2 is a sectional view illustrating a melt chamber and the proximity thereof of the diecasting apparatus according to the invention.
Figure 2:
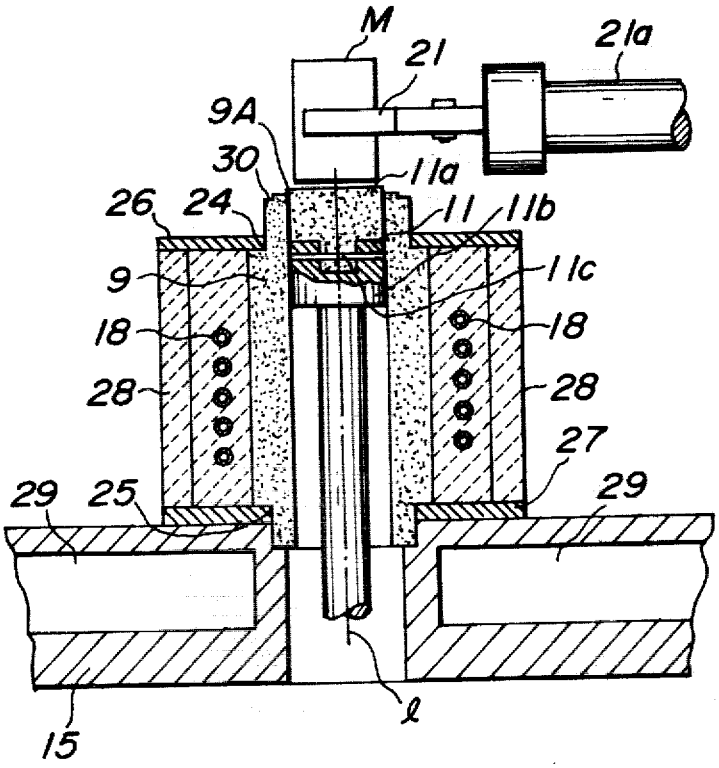

An injection cylinder 8 for pressure injecting molten metal into the cavity 3 is arranged passing through the base 7 and the center portion of the lower die 2 to communicate through a communicating portion 8*a* with the cavity 3. Cylinder 8 includes a lower opening adapted to be connected with an upper opening of a melt chamber cylinder 9 which is vertically movable and forms a part of the injection system. The connection between the injection cylinder 8 and the melt chamber cylinder 9 will be explained later. An axis l of the injection cylinder 8 is aligned with an axis l of the melt chamber cylinder 9 and an axis l along which is moved a plunger 11 provided on an upper end of a piston rod of the cylinder 10 explained herein. The injection cylinder 10 is fixed to a substantially center portion of U-shaped bracket 12 depending from and fixed to the underside of the inverted U-shaped base 7. Between the bracket 12 and the inverted U-shaped base 7 are arranged screw shafts 14 adapted to be rotated by means of pulse motors 13. Shafts 14 are threadedly engaged with a movable base 15 which is vertically movable when the pulse motors are energized. The movable base 15 is formed along the axis l with a passage 17 for receiving the plunger 11 of the injection cylinder 10. On an upper periphery of the passage 17 is upstandingly located the melt chamber cylinder 9. The upper end face of the melt chamber cylinder 9 is therefore adapted to abut against and move away from the lower end face of the injection cylinder 8 by the action of the pulse motors 13. FIG. 1 illustrates the melt chamber cylinder 9 in an abutting and connected position. A melt chamber is formed by the upper surface of the plunger 11 and the inner surface of the melt chamber cylinder 9. About the melt chamber cylinder 9 is arranged a high frequency induction coil 18 for heating and melting the material to be melted in the melt chamber. Cooling water is introduced about the coil 18 and exhausted through water pipes 22 from a cooling water reservoir (not shown). The material M to be charged into the melt chamber is gripped by gripping arms 21 of a material supply device 20 arranged beside the inverted U-shaped base 7 and then fed above the plunger 11 forming the bottom of the melt chamber when the melt chamber cylinder 9 has lowered as shown in FIG. 2 and thereafter the material M falls onto the plunger when the gripping arms 21 are opened. In FIG. 1, electric current is supplied to the coil 18 through supply cables 23, and cooling water is supplied to the movable base 15 through water pipes 29.

The respective parts of the apparatus above described will be explained in more detail.

MELT CHAMBER

The melt chamber cylinder 9 used in the apparatus according to the invention has an inner diameter substantially the same as that of the injection cylinder 8. The metal melted in the melt chamber is only maintained on the plunger 11 as a bottom plate of the chamber but scarcely exerts a pressure, so that a fitting between the plunger and the inner diameter of the melt chamber cylinder 9 need not be precise in comparison with the fitting between the plunger and the inner diameter of the injection cylinder 8. The clearance between the plunger 11 and melt chamber cylinder 9 is preferably 0.1–0.3 mm. The melt chamber cylinder 9 must be refractory and heat-resistant and is required to have a property preventing cracks due to heating and further to be resistant to the wear due to mechanical sliding movements of the plunger 11. Therefore, the cylinder 9 is preferably made of a ceramic material. It has been found in experiments that silicon nitride ceramic is the most preferable for this purpose. However, other high grade and high purity furnace material may be applicable such as carbide, alumina, silica and zirconia ceramics. It may be selected from these ceramics in consideration of desired diecasting temperatures, amounts of molten metal and injection conditions in view of economics.

Figure 3:
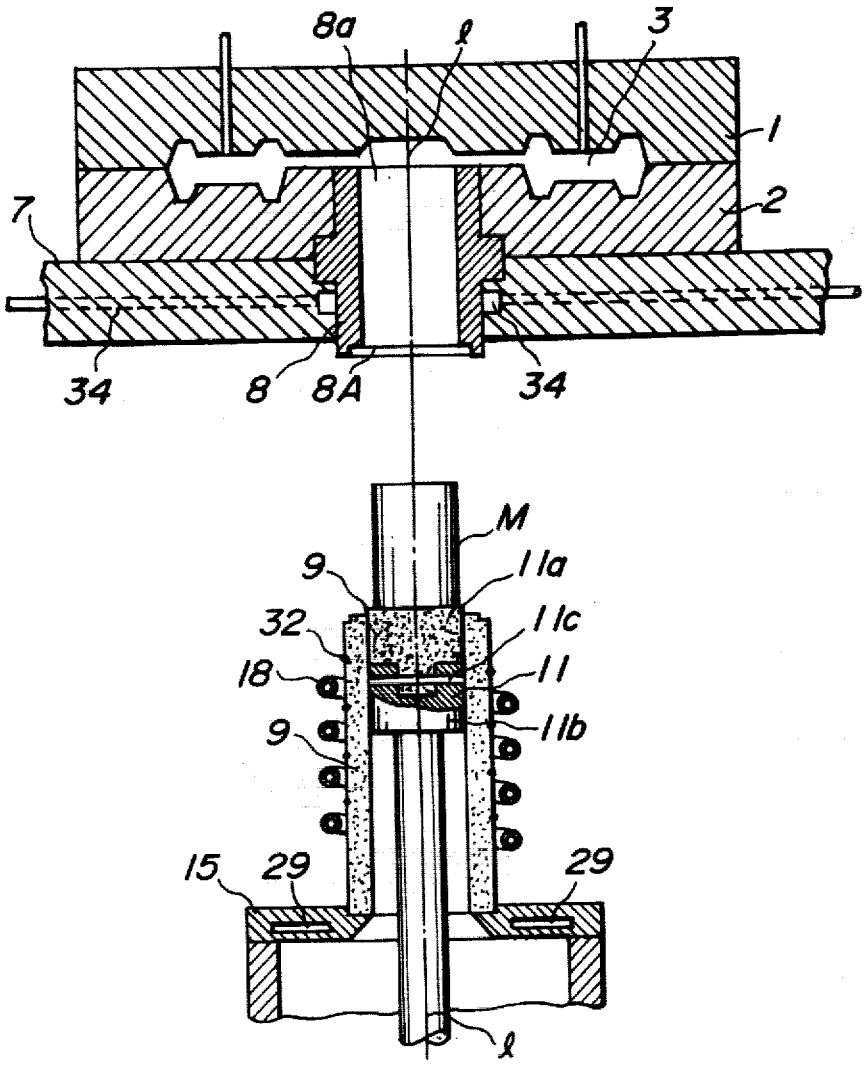
FIG. 3 is a sectional view showing a connection of the melt chamber with an injection cylinder of the apparatus according to the invention.

FIGS. 2 and 3 illustrate the construction of the melt chamber cylinder 9. The cylinder 9 is formed in its upper and lower ends with shoulders 24 and 25 onto which are fitted restraining plates 26 and 27 between which are embraced and combined a support frame 28. The lower retaining plate 27 is fixed to the movable base 15 to secure the melt chamber cylinder 9 thereto. The plates 26 and 27 and support frame 28 are preferably formed of asbestos ramming materials. Particularly, the lower restraining plate 27 is desired to have a thermal insulating property because it is in contact with the movable base 15. Between the melt chamber cylinder 9 and support frame 28 is arranged the high frequency induction coil 18 electrically insulated as heating and melting means. A refractory thermal and electric insulating material is preferably filled between the coil 18 and the outer circumference of the melt chamber cylinder or support frame 28. The movable base 15 is likely to be subjected to the high temperature heating, so that the water pipes 29 are provided to cool the movable base 15 in order to avoid any undesirable effect of the high temperature heating.

Figure 6:
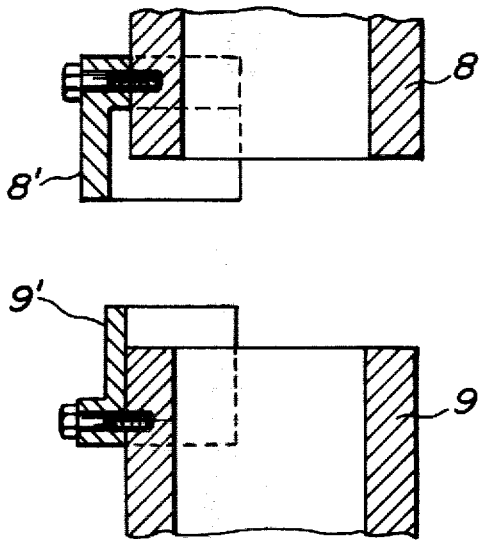
FIG. 6 illustrates one embodiment of the connection between the injection and melt chamber cylinders of the apparatus according to the invention.

In order to keep a concentric connection of the melt chamber cylinder 9 relative to the injection cylinder 8, according to the embodiment the melt chamber cylinder 9 at its upper end face and the injection cylinder 8 at the lower end face are provided with stepped portions 30 and 31 to be fitted with each other. With this arrangement, the cylinders 8 and 9 can be tightly connected to avoid any metal penetration therebetween and be kept with a high concentricity of the cylinders. Instead of the stepped portions, as shown in FIG. 6 a semicylindrical connection may be used which comprises an upper semicylinder part 8' adapted to be bolted to the injection cylinder 8 and a lower semicylinder part 9' bolted to the melt chamber cylinder 9, these parts being closely fitted with each other which obtained good results in experiments. In order to obtain a smooth transition between the insides of the cylinders 8 and 9, the inside of the lower end of the injection cylinder 8 is preferably tapered to render the inner diameter of the lower end of the injection cylinder 8.

ADDITIONAL CONSTRUCTION OF THE MELT CHAMBER

In addition to the high frequency induction coil 18 as heating and melting means for the material M to be melted, as shown in FIG. 3, separate heating means 32, for example, a nichrome wire is arranged about the melt chamber cylinder 9 to improve the thermal condition in the melt chamber. In some experiments, with low quality furnace materials cracks often occur in walls of the melt chamber in several uses due to rapid thermal transmission in the material by the high frequency induction heating. Such cracks are caused by the repetition of the rapid heating and the cooling by natural heat radiation of the melt chamber cylinder 9. It is, therefore, preferable for a melt chamber made of low quality furnace material to be brought into a preheated condition to avoid thermal shocks when starting the heating for melting. In the experiments, the nichrome wire as the heating means 32 was coiled about the outer circumference of the melt chamber, to which was supplied electric current to preheat the melt chamber for this purpose. As the result durability of the melt chamber could be remarkably improved. In case of the melt chamber cylinder 9 made of a suitable high grade and high purity furnace material or suitably determined injecting conditions, however, such a preheating is not necessarily required.

INJECTION CYLINDER

Figure 4:
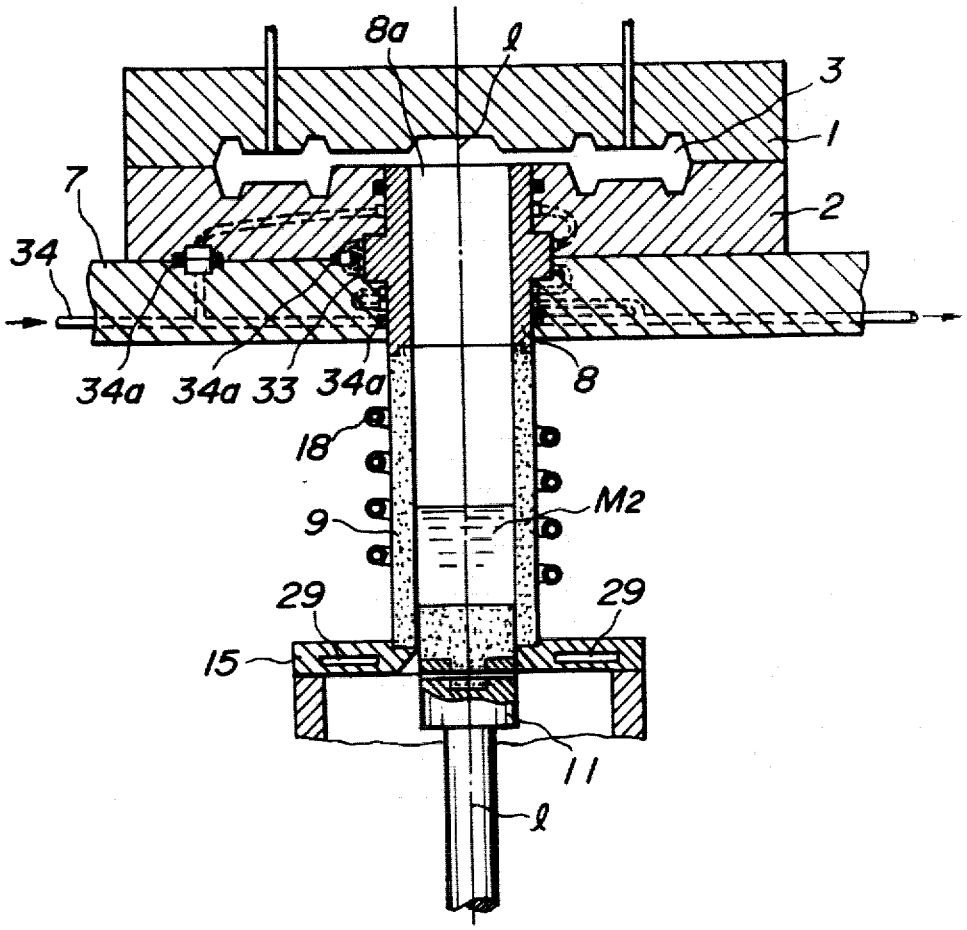
FIG. 4 is a sectional view illustrating cooling means used in the apparatus according to the invention.

The injection cylinder 8 is subjected to the high pressure of the molten metal when it is injected into the cavity 3, so that the fitted relation between the injection cylinder 8 and plunger 11 must be precise. It has been found in the experiments that clearances of 0.03–0.15 mm therebetween are suitable. In consideration of mechanical strength against the high pressure of the molten metal and workability to obtain such severe tolerances, ceramics, cermets or the like are the most suitable for making the injection cylinder 8, and tungsten, molybdenum, nickel or iron base alloy is next thereto. In case of the latter alloys, however, there is a risk of change in dimension, for example, elongation in diameter due to thermal deformation. To avoid this, a cooling passage 33 or 34 may be preferably provided as shown in FIGS. 2 and 4. Referring to FIG. 4, the cooling passages 34 may be provided in the stationary die 2 and the inverted U-shaped base 7 into which the injection cylinder 8 is fixed. In this case, air-cooling system is preferable because of a difficulty of sealing between the associated members. In FIG. 4, a numeral **34*a* illustrates sealing members. In the embodiment shown in FIG. 2, a cooling passage is preferably branched off the cooling passage 33 to cool the inverted U-shaped base 7 and stationary die 2**.

PLUNGER

The plunger 11 according to the invention also serves as a bottom plate of the melt chamber. It is essential to avoid any leakage of the molten metal flowing through a clearance between the outer peripheral surface and inner wall of the melt chamber. In order to prevent such a leakage it is preferable to make the clearance within 0.1–0.3 mm. It has been found in experiments that if the clearance is less than that value, a sliding resistance between the plunger and the inner wall of the melt chamber increases to shorten the life of the melt chamber, while with a clearance more than that value the molten metal tends to leak therethrough.

In this embodiment, as the high frequency induction coil 18 is arranged about the melt chamber, the plunger 11 itself forming the bottom of the melt chamber must be protected from being heated and melted. In the embodiments shown in FIGS. 2–5, a plunger head **11*a* is provided for this purpose, which is made of the same material as that of the melt chamber cylinder 9. The plunger head 11*a* is made of the ceramic material particularly in consideration of the wear-resistant property and is jointed with a plunger holder 11*b* by means of a pin, bolt or other fastening means 11*c*. The plunger head 11*a* and plunger holder 11*b* may be threadedly connected. In this case, however, the plunger head 11*a* must be made of a material having a good workability. The plunger head 11*a* constructed as above described and made of the ceramic material is not directly heated by the induction coil 18** and provides a sufficient heat-resistance against the molten metal.

The diecasting method according to the invention will be explained in the order of its steps referring to FIGS. 2–5.

I Supply process of material to be melted.

The material M to be supplied into the melt chamber for melting is previously adjusted in component and preferably sufficiently degassed and is in the form of an ingot or billet having a volume corresponding to the capacity of the cavity. Such a material M is usually supplied at the room temperature. In case of high melting point metals such as iron, superalloy or the like, it is often preheated at approximately 600–1,000° C. for the purpose of shortening the time for melting and diecasting cycles.

The material M to be melted is fed in the proximity of the material supply device 20 and is then gripped by means of the gripping arms 21. On the other hand by energization of the pulse motors 13 the movable base 15 is lowered to separate sufficiently the melt chamber cylinder 9 from the injection cylinder 8 as shown in FIG. 2. The pulse motors 13 are controlled by means of limit switches or the like to determine the lowermost position or material supply position and the uppermost position or connection position of the movable base 15 or melt chamber cylinder 9. When the melt chamber cylinder 9 has lowered to the material supply position, the position of the cylinder is detected by a separate limit switch or the like to control the material supply device. With this arrangement, the material M to be melted is brought by means of the supply arms **21*a* immediately above the melt chamber cylinder 9 which has been lowered at the material supply position, and the gripping arms are then released to put the material M on the upper surface of the plunger head 11*a*. Inherently, the position of the plunger 11 in the material supply step can be determined at will. In case of a material in the form of a billet, however, in order to obtain a smoother charge of the material, the plunger 11 is so set that its upper surface is slightly above the upper opening 9A of the lowered melt chamber cylinder 9, and the material M is moved above the upper surface of the plunger 11 and then put thereon by releasing the gripping arms 21. Thereafter, the melt chamber cylinder 9 is raised so as to abut against the injection cylinder 8 as shown in FIG. 1**. Now, the apparatus is ready for the melting operation.

The cylinder 10 may be operated in multiple steps. In this case, the melt chamber cylinder 9 and injection cylinder 8 are bodily fixed and after the material M is put on the plunger head 11*a* in the same manner above described when the plunger is in the lowermost position, the plunger is raised to the position ready for melting operation as shown in FIG. 1. The base 15 is of course stationary. However, the base 15 which is movable as in the embodiment shown in the drawings is preferable in order to facilitate reparing and replacement of the melt chamber apt to be worn off.

On the other hand, the dies may be opened or closed when the material is being supplied to the melt chamber. After completion of the material supply process, however, the dies are immediately closed to be ready for heating and melting in a next process.

II Melting process

After the completion of the supply of the material in the previous process, which is detected, for example, by the release of the gripping arms 21, the pulse motors 13 are energized by a signal indicating the direction of the release of the gripping arms to raise the melting chamber cylinder 9 so that the stepped portions 30 and 31 of the melt chamber cylinder 9 and injection cylinder 8 are tightly fitted with each other to concentrically align the upper opening 9A of the melt chamber cylinder 9 with the lower opening 8A of the injection cylinder 8. Under this condition of the melt chamber cylinder 9 and injection cylinder 8 to form an integral injection cylinder, high frequency current is supplied to the high frequency coil 18, which are the heating and melting means, to heat and melt the material M in the melt chamber (FIG. 4).

In melting a high melting point metal by the high frequency induction coil 18, time for melting must be as short as possible and heating must be given to the material at a relatively high rate. Such a great amount of thermal input for a short period of time can effectively melt the material M. The rate of thermal input per unit time is preferably 2.0–20 cal/g/sec depending upon materials to be melted in carrying out the invention. The rate of thermal input can be variously changed by varying the electric power, time for supply or the like to the high frequency induction coil 18. It is economical for the operation of the coil to limit the rate of thermal input to as short a time as possible so long as the diecasting cycle is not elongated. Since it is usually required to limit the diecasting cycle of this kind within 150 sec. for productivity, the time for melting is desired to be at the most 120 sec. or less. In this case, the rate of thermal input is 2 cal/g/sec and therefore an active current of about 15 kW is needed for a billet of 2 kg. If the electric input is increased, the time for melting is shortened. Under this condition, however, it is required to prevent the molten metal from spattering or splashing due to stirring or agitation of the magnetic induction. Particularly it is needed to prevent the magnetic field from spreading above the melt chamber. In experiments, with a material of 2 kg, the stirring by the magnetic induction occurred and then the spattering of the melt occurred when an active current more than 150 kW was supplied. The active current of 150 kW corresponds to a rate of thermal input 20 cal/g/sec. The time for melting was 15 sec.

The final temperature of the melt immediately before injection is selected to be 100°–200° C. higher than the melting point of the material. This is determined by suitably selecting the power and time to be supplied to the high frequency induction coil obtained by the total thermal input calculated according to the material, shape and weight of the metal. Moreover, in carrying out the method according to the invention, all that is required for the power supply is the setting of the time for the power above described but any control of electric power during melting is usually not needed.

Immediately after the completion of the melting the material M in the melt chamber in this manner, an injection process is started. This transfer to the injection process is effected by energizing the injection system with the aid of a signal from a time switch in which the time for the power supply is set.

III Diecasting process

Figure 5:
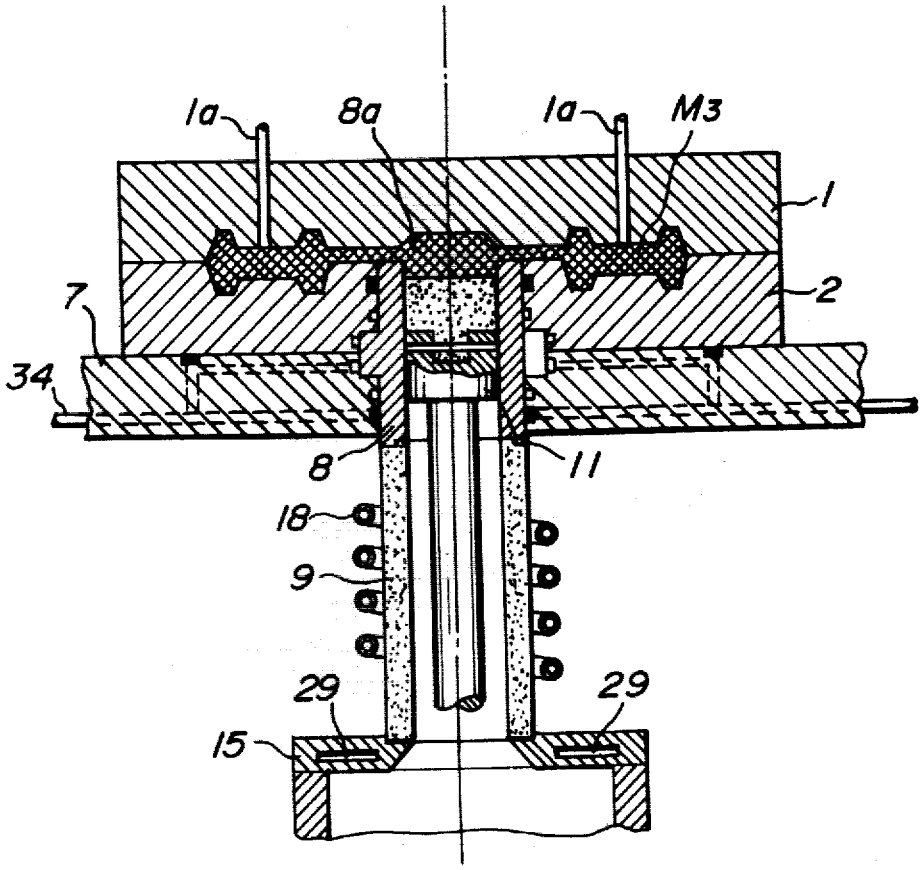
FIG. 5 is a sectional view explaining heating means other than the high frequency induction coil used in the apparatus according to the invention.

The high melting point metal $M_2$ in a temporarily reserved condition melted in the above melting process is injected and filled into the cavity 3 defined by the upper and lower dies 1 and 2 through the melt chamber cylinder 9, the connection between the cylinders 9 and 8, the injection cylinder 8 and the communicating portion 8*a* of the injection cylinder 8 connected to the lower die 2 in consequence of the raising of the plunger 11 forming the bottom of the melt chamber (FIG. 5). In the injection, the upper and lower dies are clamped by means of the toggle mechanism 5 operated by the advance of the die clamping cylinder 4 by a clamping force required to obtain a high quality product against the pressure applied through the molten metal to the dies 1 and 2. The molten metal $M_2$ itself is not subjected to a considerable force when it is raising in the melt chamber cylinder 9, but the metal $M_2$ is subjected to a great force for filling the metal into the cavity 3. Such a great increasing force begins at a moment when the plunger 11 raising in the injection cylinder 8 has arrived in the proximity of its uppermost position. It is advantageous for improving the life of the melt chamber cylinder 9 and other components that the plunger 11 is driven at a low speed until it has passed through the melt chamber cylinder and is driven at a higher speed after it has reached the inside of the injection cylinder 8.

After the metal $M_2$ in the cavity 3 has solidified sufficiently, the die clamping cylinder 4 is retractively operated in a reverse manner to raise the upper die through the toggle mechanism 5 so as to open the dies. The applying of pressure by the injection cylinder 10 is continued until the moment of the opening the dies. The diecast product $M_3$ is therefore raised attached to the upper die 1 and then separated and ejected from the upper die 1 by an action of ejector pins 1*a*. See FIG. 5. Thereafter, the plunger 11 is returned to its original position. The upper and lower dies 1 and 2 and injection cylinder 8 are then cleaned or coated with parting agents, if required, for the next diecasting cycle.

Figure 7:
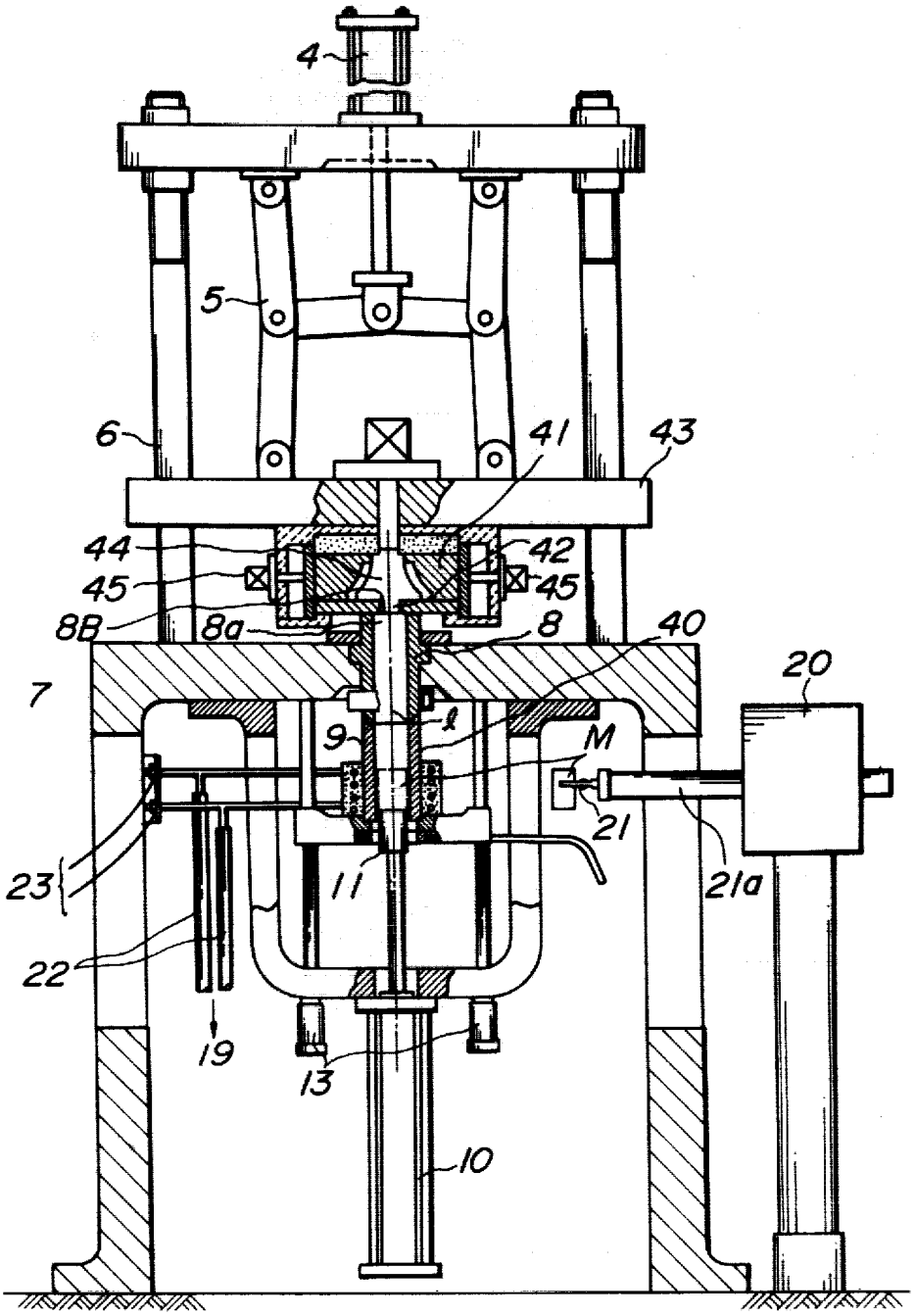
FIG. 7 is a front elevation of a second embodiment of the apparatus according to the invention.
Figure 8:
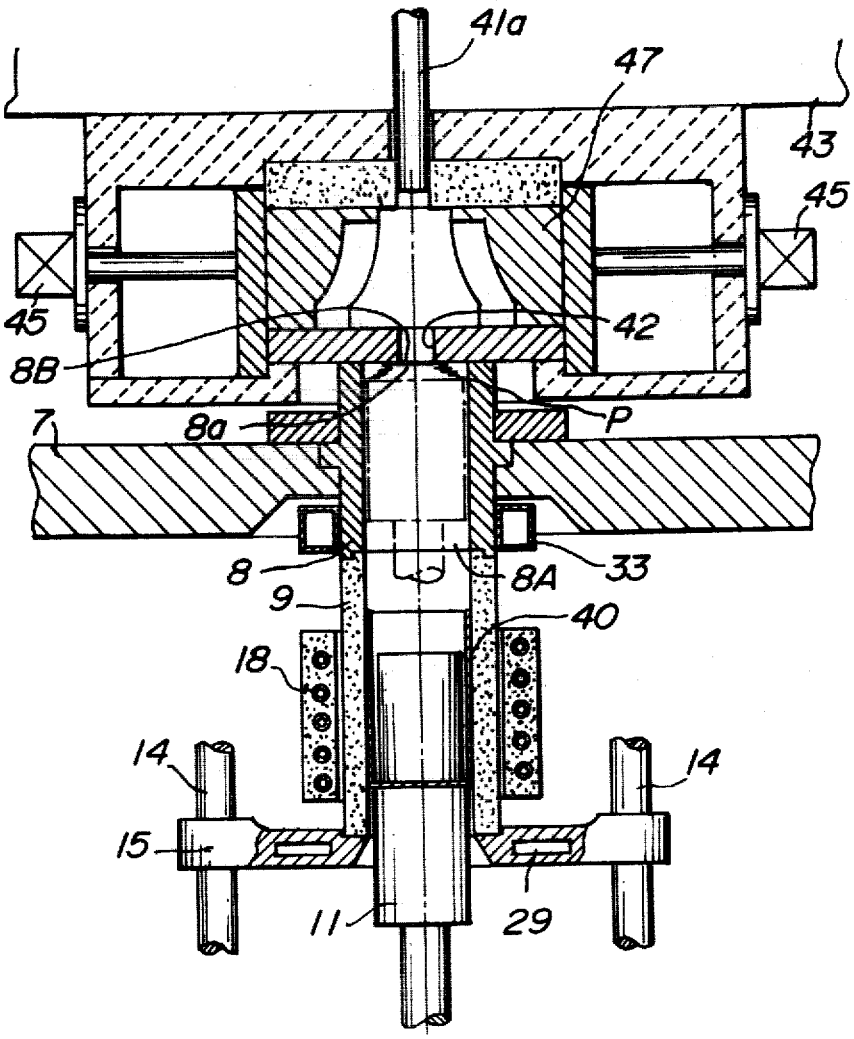
FIG. 8 is a sectional view of the essential part of the apparatus shown in FIG. 7.

FIGS. 7 and 8 illustrate the second embodiment of the invention which is mainly characterized in a cup-shaped insert 40 accommodating a material M which is charged in a melt chamber for melting. Different from the dies in the first embodiment, dies are formed with a cavity in symmetry with respect to an axis l and consist of a plurality of divided dies 41 which radially advance or retract to close or open the entire dies such that a sprue runner 42 is formed when the dies are closed. An entire die device including the dies is fixed to an upper ram 43 and movable along a guide bar 6 by means of a toggle mechanism 5 operated by extension and retraction of a die clamping cylinder 4. With this arrangement, an upper end surface of an injection cylinder 8 arranged in an inverted U-shaped base 7 as in the first embodiment abuts directly against a die end face at the lower end of the sprue runner 42 of the dies to communicate the injection cylinder 8 with the cavity 44 through a communicating portion 8*a* and the sprue runner 42.

The cup-shaped insert 40 serves as so-called a "cup" for melted metal to protect inner walls of the injection cylinder 8 and melt chamber cylinder 9 from being overheated. For this purpose, the insert 40 is made of inorganic thermal insulating fibrous materials, as aggregates, for example, one or more selected from silicic anhydride, calcium fiber, silica fiber, alumina fiber, silica alumina fiber, crystal asbestos fiber, zirconia fiber or the like. These fibers having usually diameters of about 1–10μ and lengths of 2–30μ are processed in substantially the same manner as in paper making to form paper-like materials which are then formed in cup-shapes. These materials have the inorganic thermal insulating fibers complicatedly entangled to obtain the higher thermal insulation resulting from the thermal insulation of the materials themselves in conjunction with the thermal insulation of air insulating layers. The cup-shaped insert 40 is preferably sintered to purge gaseous components contained in organic materials used in the paper making process. This sintering of the insert 40 serves to prevent the gaseous components from mixing into the metal $M_2$ in melting process and to strengthen the paper wall so as not to cause a premature breakage due to the weight and vibration of the molten metal before it is filled in the dies.

By the use of the cup-shaped insert 40, the life of the melt chamber can be considerably elongated. The cup-shaped insert 40 effectively keeps the molten metal at the desired temperature until the diecasting process. In fact, however, the heat of the molten metal is partly lost through the upper surface of the plunger 11 and the injection cylinder 8 during the time from the melting to the injecting of the metal. It is, therefore, preferable to determine the casting temperature 100° C. higher than the melting point of the metal even if the cup-shaped insert 40 is used. Although it is inherently desirable to limit the overheating to the minimum in view of the durability of the melt chamber cylinder 9 or the like, the heating 100° C. or more higher than the melting point is desirable for maintaining a suitable flowability of the molten metal flowing into the cavity.

In using the cup-shaped insert 40 constructed and having the functions as above described, the cup-shaped insert 40 is arranged on the plunger 11 and thereafter the material to be melted is received in the insert in the same manner as in the first embodiment or the insert 40 in which the material to be melted has been accommodated is arranged on the plunger 11. The spaced relation been the melt chamber cylinder 9 and injection cylinder 8 and the position of the plunger 11 in the material supply process is substantially identical with those in the first embodiment. FIGS. 7 and 8 illustrate a condition of the apparatus after completion of the supply of the material M into the melt chamber and immediately before commencement of the melting process. Immediately before the melting process the upper ram 43 has lowered and the dies have closed while divided dies 41 have moved together toward each other by extension of driving cylinders 45 arranged outwardly of the dies, the upper end surface of the injection cylinder 8 abutting against the lower end of the sprue runner 42 opening at the lower surface of the dies.

Under this condition, when a current is caused to flow in the high frequency induction coil 18 which are the heating and melting means to begin the melting of the material M received in the cup-shaped insert 40, the material M begins to be melted at a rate corresponding to the supplied power until it becomes a molten metal in the cup-shaped insert 40 and stays therein. The time for power supply required to reach a desired casting temperature is substantially the same as that in the case of not using the cup-shaped insert. After the time for power supply has expired, the plunger 11 is raised so that the molten metal $M_2$ still retained in the cup-shaped insert 40 approaches the sprue runner 42 through the melt chamber cylinder 9, connection between the cylinders 9 and 8, injection cylinder 8 and communicating portion 8*a*, with the result that the upper end of the cup-shaped insert 40 abuts against the underside of the dies about the small diameter sprue runner whose inner diameter is smaller than that of the injection cylinder 8. As the result, the side periphery of the cup-shaped insert is buckled and damaged, so that only the molten metal $M_2$ which has been adiabatically maintained in the cup-shaped insert 40 is injected through the sprue runner 42 and fills the cavity 44. The advanced-most position of the plunger 11 is indicated at P in FIG. 8, which is practically determined depending upon the desired volume of the molten metal in consideration of the volume of the cavity and extra molten metal. The disrupted pieces of the cup-shaped insert 40 are therefore scatteringly piled in the extra metal (so-called "biscuit") remaining in the injection cylinder 8 between the point P and sprue runner 42. As the extra metal is removed after casting, the mixture of the disrupt pieces therein does not affect the final diecast product.

After the completion of the injection and filling of the molten metal $M_2$ in this manner, the metal is kept in the cavity 44 until its sufficient solidification and thereafter the die device is raised so as to be spaced from the upper opening 8B of the injection cylinder 8. Then the divided dies 41 are opened by the retraction of the die driving cylinder 45 and an ejector pin 41*a* is lowered to eject the diecast product (not shown). Thereafter the plunger 11 is retracted. In this manner the series of diecasting processes have been completed. The extra metal including the disrupt peices of the cup-shaped insert which has been removed from the diecast product is used for separate purposes.

As can be seen from the two embodiments of the invention as above described, it can be understood that according to the invention after the molten metal M has been supplied in the melt chamber, the upper end opening 8B of the injection cylinder 8 abuts against the closed die device to communicate the melt chamber, injection and die systems with each other but these systems are hermetically closed as a whole with respect to the exterior. This is the great advantage of the invention, which makes it possible to effect with ease diecasting with the aid of the vacuum melting utilizing the hermetically closed construction.

This construction will be explained as a third embodiment of the invention hereinafter. As shown in FIG. 1, in the outer peripheries of the cavity 3 at the jointed surfaces of the upper and lower dies 1 and 2 are provided air vents 46 whose air contained therein is removed through an air suction pipe 47 into a vacuum tank (not shown), thereby evacuating the cavity 3 (44), sprue runner 42, injection cylinder 8 and melt chamber cylinder 9. The air vents 46 communicate with the cavity 3 (44) through fine grooves 46*a* whose diameters are so fine as not to cause the molten metal to flow therethrough. Filters may be provided in the vents as the case may be. The cavity 3 may be intentionally provided with continuous overflowing portions for the molten metal through which the evacuation may be effected. With this third embodiment, in addition to the air vents for the evacuation, through-passages 48 may be provided to communicate with the cavity, through which is introudced an inert gas into the system, thereby replacing the air with the inert gas. In this case, the inert gas may be used only when the metal is being melted and after the completion of the melting the supply of the inert gas may be stopped and the remaining gases may be exhausted out of the system for example through the suction pipe 47 to prevent the gases from mixing into the molten metal when it is injected into the cavity. These operations have been carried out in diecasting processes in the prior art. According to the present invention, however, a series of the melting, injecting and filling of the material is carried out in hermetically closed systems without requiring any pouring operation at a pouring gate, so that an ideal atmosphere can be obtained in the hermetically closed systems. With the prior art systems, it is impossible to prevent the atmosphere from entering a cavity when pouring a metal and in order to overcome this problem a great bulky hermetically closed chamber is therefore needed. In contrast herewith, according to the present invention because of the hermetically closed steps, diecasting can easily be effected in the event of metal containing aluminum, titanium or the like apt to be oxidized by the reaction with the air. Furthermore, the present invention has an advantage of eliminating a defect of casting resulting from the air or the like enclosed in the molten metal.

Experiments with respect to the diecasting method and apparatus according to the invention will be explained hereinafter.

EXPERIMENT 1

Tests of diecasting were effected under the conditions shown in Table 1 by the use of a vertical diecasting apparatus having a melt chamber cylinder made of $Si_3N_4$ having an inner diameter of 60 mm and outer diameter of 90 mm, an injection cylinder made of a tungsten base alloy having an inner diameter substantially the same as that of the melt chamber cylinder and a plunger head made of a material the same as that of the melt chamber cylinder.

TABLE 1

| | |
|---|---|
| Injection pressure | 150 kg/cm$^2$ |
| Injection speed | Low speed advance 0.2 m/sec.<br>High speed advance 0.6 m/sec. |
| Temperature of dies | 380° C. |
| Output of coil | 120 kW (4kHz) |
| Metal | SUS 304 |
| Shape | 50ϕ × 90 mm |

Stainless steel of 1.4 kg shown in Table 1 was charged in the melt chamber in the manner substantially the same as that described in the first embodiment. During the charging, the dies were maintained at 380° C. The cleaned surfaces of the cavity of the dies were coated with a parting material and inner walls of the injection cylinder were coated with a lubricant. The metal was arranged on the plunger head and the melt chamber cylinder was raised so as to be connected with the injection cylinder and thereafter electric power of 120 kW was supplied for about 40 seconds to melt the stainless steel. In injecting the molten stainless steel, it was advanced at a lower speed 0.2 m/sec until a plunger head had passed the melt chamber and thereafter at a higher speed 0.6 m/sec. The time of 40 seconds for supplying the power 120 kW to the high frequency induction coil was determined by the results of separate experiments for obtaining molten metals at 1,500°-1,600° C.

In the experiments, the weight of products corresponding to the cavity was 900 g and the weight of extra metals (biscuits having a length of 2.3 cm) was 500 g. It took approximately 7-13 seconds for the operations from the injection to the separation of the dies. In this case, after the movable die had been separated from the stationary die, the ejector pin was operated and simultaneously the plunger was retracted. At the moment when the plunger had returned to its original position, the pulse motors were energized to lower the melt chamber cylinder to the material supply position. Thereafter, the material was supplied for a next diecasting. The cycle time during these operations is approximately 80-90 seconds.

EXPERIMENT 2

Nickel base vacuum melting metal (Inconel 718) and Ferrite base vacuum melting metal (A286) were used for diecast metals. In this case, the die, injection and melt chamber systems were evacuated to purge the air therein in the manner as described in the third embodiment. The operation for the evacuation was effected with the aid of air vents having a depth of 0.2 mm and a width of 15 mm. The evacuation started at the moment of an information for power supply to the high frequency induction coil and continued for approximately 40 seconds until the injection and filling of the metal during which the insides of the systems were evacuated to about 20-30 Torr. The degree of the evacuation can be suitably determined by capacities of used equipment such as a vacuum tank, pump or the like and sealing performance of the systems.

The metals of the two kinds above described were diecast in the manner substantially the same as that in the Experiment 1. Table 2 show amount of components of the metals and gases contained therein.

TABLE 2

| Material | | Amount of components and gases | | | | | | | | | | | | | |
|---|---|---|---|---|---|---|---|---|---|---|---|---|---|---|---|
| | | C | Si | Mn | Cr | Mo | Ni | Fe | Ti | Al | Nb | B | Cu | (O) | (N) |
| Inconel | Material | 0.04 | — | — | 19.02 | 3.15 | remainder | 18.51 | 0.92 | 0.39 | 4.86 | — | 0.18 | 5 | 48 |
| 718 | Product | 0.04 | — | — | 19.00 | 3.06 | remainder | 18.49 | 0.93 | 0.38 | 4.87 | — | 0.16 | 5 | 41 |
| A286 | Material | 0.05 | 0.43 | 1.45 | 15.76 | 1.27 | 27.10 | remainder | 2.15 | 0.22 | — | 0.003 | — | 33 | 86 |
| | Product | 0.05 | 0.39 | 1.16 | 15.81 | 1.31 | 27.13 | remainder | 2.18 | 0.19 | — | 0.003 | — | 41 | 92 |

The inventors had known that when the vacuum melting metals above described were melted in the atmosphere in a usual manner, the Inconel 718 generally lost considerable amounts of Mo and Cu and 25% of Ti and Al and increased 60-70% of total gases contained in the metal, while A286 generally lost 30% of Mn and 15% of Ti and Al and increased 60–150% of total gases in a wide range. In contrast herewith, according to the invention the change in components and total gases of the materials before and after diecasting is very small as shown in Table 2 of the Experiment 2.

Furthermore, while argon gas was being introduced into the systems, the metals were melted and thereafter the argon gas was rapidly sucked into a vacuum vessel at $10^{-3}$ Torr separately prepared immediately before the injection. In this case, the changes in components of the metals were much less than those shown in Table 2. With respect to the total amounts of gases, particularly nitrogen, there is a tendency of them to reduce in the products. Such an operation in the inert gas atmosphere is effective to maintain the diecasting condition properly even if the sealing of the apparatus becomes worse. In the experiments, there were no diecasts having defects resulting from gases included therein.

EXPERIMENT 3

The cup-shaped inserts described in the second embodiment were used. The cup-shaped inserts were made of the inorganic adiabatic material of the second embodiment in the form of a bottomed-cup having a diameter of 59 mm, a height of 60 mm and thickness of wall of 0.8 mm. The insert was previously inserted in the melt chamber having an inner diameter of 60 mm. The metal was a billet having a diameter of 40 mm and a length of 15 mm. The used apparatus was substantially similar to that shown in FIGS. 7 and 8. Divided dies adapted to form a sprue runner having a diameter of 20 mm smaller than the inner diameter of 60 mm of the injection cylinder were used in order to avoid disrupt pieces of the insert from entering the sprue runner system when injecting the metal. Power of 120 kW was supplied for 40 seconds (4 kHz) for melting. The construction of the melt chamber was similar to that in the Experiment 1. In injecting the metal, it was advanced at a lower speed 0.02 m/sec until a plunger head had passed the melt chamber and thereafter at a higher speed 0.6 m/sec. Such an initial low speed prevents the walls of the melt chamber from being damaged and further prevents the cup-shaped insert accommodating the molten metal therein from being ruptured when it is transferred toward the cavity of the dies. The considerably lower initial speed for advancing the plunger than that of the Experiment 1 can be achieved because of the thermal insulating property of the cup-shaped insert.

As can be seen from the above description, since the melting of metal is effected in the cup-shaped insert which keeps the molten metal therein until the later period of the injection, the molten metal is not in direct contact with the walls of the melt chamber, thereby considerably elongating the life of the melt chamber in comparison with the case of not using the cup-shaped insert. It has been found in the experiments that the melt chamber could be used repeatedly as much as one hundred and several tens, and on the other hand without the cup-shaped insert the walls of the melt chamber became worse after use of only ten and several times. Moreover, because of the heat keeping effect of the cup-shaped insert, a good flowability of the molten metal is effectively maintained until it is injected into the cavity, thereby improving its filling capacity thereinto.

As can be seen from the above description the diecasting apparatus according to the invention has various advantages which enable the invention to be widely industrially applicable and have been never achieved in the prior art. In other words, the coaxially arranged melt chamber, injection cylinder and cavity enable high melting point metals to be melted in the hermetically closed systems and to be injected into cavities immediately after they have been melted. The melt chamber and injection cylinder are separately formed in the embodiments shown in the drawings because if they are integrally formed, the usable one must be uneconomically discarded when the other becomes unusable. In view of the technical purpose, however, they may be integrally formed with each other.

The effects of the invention are as follows.

(1) A melting shop is not needed. All the handlings of molten metals such as pouring are eliminated. Melting process using a melting furnace or the like and control of molten metals are not needed. According to the invention precision diecasting is accomplished by considerably simple construction and operation in comparison with the prior art apparatuses and methods which need various accompanied installations.

(2) The air entrainment when injecting the metal into a cavity scarcely occurs.

(3) With the prior art pouring system, a diecasting temperature has been determined in a holding furnace, so that the molten metal has had to be overheated resulting in premature damage of the constitutional equipment. In contrast herewith, according to the invention as the temperature of the molten metal can be effectively maintained, heating at the lowest possible temperature may be permitted for melting, increasing the durability of the apparatus, and the good flowability of the molten metal can be maintained until it is injected, thereby obtaining diecast products of good runs of metal.

(4) As the required volume of the molten metal is determined by a volume of solid material, the regulation of the volume can be correctly effected to reduce the superfluous material.

(5) The air in the melt chamber, injection cylinder and cavity forming the coaxially connected hermetically closed systems is evacuated to reduce its pressure when the material is being melted and replaced by an inert gas, so that there are scarecely differences in components between materials and diecast products to obtain high quality diecast products.

(6) The vacuum remelting and vacuum casting which are indispensable for the vacuum melting metals in connection with the item (5) are effected in the same apparatus.

(7) The series of the processes from melting to injecting can be carried out by the same apparatus and it is also possible to automate these operations.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A vertical diecasting apparatus comprising a diecasting cavity, a vertically arranged injection cylinder having its upper end in communication with said cavity, a melt chamber cylinder coaxially located below said injection cylinder and having an inner diameter substantially the same as said injection cylinder, a base member adapted for vertical movement, means for moving said base member, said melt chamber cylinder being secured to said base member for movement therewith toward and away from said injection cylinder, so that when said base member is lowered, the melt chamber cylinder is spaced apart from the injection cylinder to provide a space for supplying the material to be melted, a movable plunger adapted to pass through said melt chamber cylinder and said injection cylinder to form a melt chamber defined by an upper surface of said plunger and an inner surface of said melt chamber cylinder, said melt chamber cylinder in abutment with said injection cylinder and said cavity all forming a hermetically closed space, and heating and melting means comprising a high frequency induction coil and a resistance heating body arranged about said melt chamber cylinder for melting a solid material inserted therein to be injected into said cavity when melted, said resistance heating body arranged between said coil and said melt chamber for preheating said melt chamber to mitigate rapid heating by said coil, wherein said melt chamber is a ceramic material composed of at least one material selected from high grade furnace materials of alumina, silica and zirconia ceramics and carbide and nitride materials.

2. A diecasting apparatus as set forth in claim 1, wherein said injection cylinder is made of at least one material selected from tungsten, molybdenum, nickel and iron base alloys and cermet and ceramics and is provided about its lower end adjacent to said melt chamber with a cooling system.

3. A diecasting apparatus as set forth in claim 1, wherein an engagement portion is provided for abuttingly engaging said cylinders in a coaxial relation at a lower end of said injection cylinder and at an upper end of said melt chamber cylinder, the lower end and the upper end being able to be in contact with and spaced apart from each other.

4. A diecasting apparatus as set forth in claim 3, wherein said engagement portion comprises stepped portions to be fitted with each other formed in a lower surface of said lower end of said injection cylinder and in an upper surface of said upper end of said melt chamber cylinder.

5. A diecasting apparatus as set forth in claim 3, wherein said engagement portion comprises an upper semicylindrical part to be bolted to said injection cylinder and a lower semicylindrical part to be bolted to the melt chamber cylinder, these parts being closely fitted with one other.

6. A diecasting apparatus as set forth in claim 1, wherein said plunger comprises a plunger head and a plunger holder thereunder and integrally clamped thereto.

* * * * *